US005527757A

United States Patent [19]

Uyttendaele et al.

[11] Patent Number: 5,527,757

[45] Date of Patent: Jun. 18, 1996

[54] RECORDING MATERIAL FOR DIRECT THERMAL IMAGING

[75] Inventors: Carlo Uyttendaele, Berchem; Roland Beels, Aartselaar; Luc Leenders, Herentals, all of Belgium

[73] Assignee: Agfa-Gevaert N.V., Mortsel, Belgium

[21] Appl. No.: 363,282

[22] Filed: Dec. 22, 1994

[30] Foreign Application Priority Data

Jan. 14, 1984 [EP] European Pat. Off. ..... 94200085

[51] Int. Cl.[6] ..... B41M 5/28; B41M 5/34

[52] U.S. Cl. ..... 503/201; 503/202; 503/204; 503/210; 503/211; 503/226

[58] Field of Search ..... 427/130–132; 503/200, 204, 210, 211, 202, 226, 201

[56] References Cited

U.S. PATENT DOCUMENTS 4,613,878 9/1986 Inaba et al. ..... 503/204

*Primary Examiner*—B. Hamilton Hess

*Attorney, Agent, or Firm*—Brumbaugh, Graves, Donohue & Raymond

[57] ABSTRACT

A non-photosensitive heat-sensitive recording material suited for use in direct thermal imaging by means of information-wise energized heating elements, wherein said recording material comprises:

(i) at least two imaging layers each containing uniformly distributed in a film-forming resin binder (1) a metal salt in thermal working relationship with (2) an organic reducing agent, and (ii) at least one heat-attenuating spacer layer for separating said imaging layers from each other.

12 Claims, 2 Drawing Sheets

RECORDING MATERIAL FOR DIRECT THERMAL IMAGING

DESCRIPTION

1. Field of the Invention

The present invention relates to a recording material suited for use in direct thermal imaging.

2. Background of the Invention

Thermal imaging or thermography is a recording process wherein images are generated by the use of imagewise modulated thermal energy.

In thermography two approaches are known:

1. Direct thermal formation of a visible image pattern by imagewise heating of a recording material containing matter that by chemical or physical process changes colour or optical density.
2. Thermal dye transfer printing wherein a visible image pattern is formed by transfer of a coloured species from an imagewise heated donor element onto a receptor element.

Thermal dye transfer printing is a recording method wherein a dye-donor element is used that is provided with a dye layer wherefrom dyed portions or incorporated dye is transferred onto a contacting receiver element by the application of heat in a pattern normally controlled by electronic information signals.

A survey of "direct thermal" imaging methods is given e.g. in the book "Imaging Systems" by Kurt I. Jacobson-Ralph E. Jacobson, The Focal Press—London and New York (1976), Chapter VII under the heading "7.1 Thermography". Thermography is concerned with materials which are substantially not photosensitive, but are sensitive to heat or thermosensitive. Imagewise applied heat is sufficient to bring about a visible change in a thermosensitive imaging material.

Most of the "direct" thermographic recording materials are of the chemical type. On heating to a certain conversion temperature, an irreversible chemical reaction takes place and a coloured image is produced.

A wide variety of chemical systems has been suggested some examples of which have been given on page 138 of the above mentioned book of Kurt I. Jacobson et al., describing the production of a silver metal image by means of a thermally induced oxidation-reduction reaction of a silver soap with a reducing agent. A heat-sensitive recording material containing silver behenate and 4-methoxy-1-naphthol as reducing agent in adjacent binder layers is described in Example 1 of U.S. Pat. No. 3,094,417.

According to U.S. Pat. No. 3,080,254 a typical heat-sensitive copy paper includes in the heat-sensitive layer a thermoplastic binder, e.g ethyl cellulose, a water-insoluble silver salt, e.g. silver stearate and an appropriate organic reducing agent, of which 4-methoxy-1-hydroxy-dihydronaphthalene is a representative. Localized heating of the sheet in the thermographic reproduction process, or for test purposes by momentary contact with a metal test bar heated to a suitable conversion temperature in the range of about 90°–150 ° C., causes a visible change to occur in the heat-sensitive layer. The initially white or lightly coloured layer is darkened to a brownish appearance at the heated area. In order to obtain a more neutral colour tone a heterocyclic organic toning agent such as phthalazinone is added to the composition of the heat-sensitive layer. Thermo-sensitive copying paper is used in "front-printing" or "back-printing" using infra-red radiation absorbed and transformed into heat in contacting infra-red light absorbing image areas of an original as illustrated in FIGS. 1 and 2 of U.S. Pat. No. 3,074,809.

As described in "Handbook of Imaging Materials", edited by Arthur S. Diamond—Diamond Research Corporation—Ventura, Calif., printed by Marcel Dekker, Inc. 270 Madison Avenue, New York, N.Y. 10016 (1991), p. 498–499 in thermal printing image signals are converted into electric pulses and then through a driver circuit selectively transferred to a thermal printhead. The thermal printhead consists of microscopic heat resistor elements, which convert the electrical energy into heat via Joule effect. The electric pulses thus converted into thermal signals manifest themselves as heat transferred to the surface of the thermal paper wherein the chemical reaction resulting in colour development takes place.

In a special embodiment of direct thermal imaging a recording material is used in the form of an electrically resistive ribbon having e.g. a multilayered structure in which a carbon-loaded polycarbonate is coated with a thin aluminium film (ref. Progress in Basic Principles of Imaging Systems—Proceedings of the International Congress of Photographic Science Köln (Cologne), 1986 ed. by Friedrich Granzer and Erik Moisar—Friedr. Vieweg & Sohn—Braunschweig/Wiesbaden, FIG. 6. p. 622). Current is injected into the resistive ribbon by electrically addressing a print head electrode contacting the carbon-loaded substrate, thus resulting in highly localized heating of the ribbon beneath the energized electrode. In said embodiment the aluminium film makes direct contact with the heat-sensitive recording layer or its protective outermost layer.

The fact that in using a recording material having a resistive ribbon structure heat is generated directly in the resistive ribbon and only the travelling ribbon gets hot (not the print heads) an inherent advantage in printing speed is obtained. In applying the thermal printing head technology the various elements of the thermal printing head get hot and must cool down before the head can print without cross-talk in a next position.

The image signals for modulating the electrode current are obtained directly e.g. from opto-electronic scanning devices or from an intermediary storage means, e.g. magnetic disc or tape or optical disc storage medium, optionally linked to a digital image work station wherein the image information can be processed to satisfy particular needs.

Heat-sensitive copying papers including a recording layer having a substantially light-insensitive organic silver salt and a hydroxylamine type reductor in a thermoplastic binder such as ethyl cellulose and after-chlorinated polyvinyl chloride are described in U.S. Pat. No. 4,082,901. When used in thermographic recording operating with thermal printheads said copying papers will not be suited for reproducing images with fairly large number of grey levels as is required for continuous tone reproduction.

The operating temperature of common thermal printheads is in the range of 300° to 400° C. as can be learned from the above mentioned "Handbook of Imaging Materials", p. 502) and the heating time per heating element (picture element) may be less than 1.0 ms, the pressure contact of the thermal printhead with the recording material being e.g. 200–500 g/cm$^2$ to ensure a good transfer of heat.

According to published European patent application No. 0 622 217 relating to a method for making an image using a direct thermal imaging element, improvements in image tone neutrality are obtained by heating the thermal recording element by means of a thermal head having a plurality of heating elements, characterized in that the activation of the heating elements is executed line by line with a duty cycle A representing the ratio of activation time to total line time in such a way that the following equation is satisfied:

$$P \leqq P_{max} = 3.3\ W/mm^2 + (9.5\ W/mm^2 \times \Delta)$$

wherein $P_{max}$ is the maximal value over all the heating elements of the time averaged power density P (expressed in $W/mm^2$) dissipated by a heating element during a line time.

Although by controlling the power supplied to the heating elements of a thermal head in the way as described in said EP-A a substantial improvement in continuous tone reproduction is obtained already, from the side of the composition of the thermal recording element further improvements to lower the image gradation are still desirable for purposes such as portrait reproduction for identification documents and image production for medical diagnosis wherein the image signals are derived from radiographic, ultrasound or nuclear magnetic resonance (NMR) recordings.

OBJECTS AND SUMMARY OF THE INVENTION

It is an object of the present invention to provide a non-photosensitive heat-sensitive recording material suited for use in direct thermal imaging, wherein said material has an improved heat-exposure latitude suited for the production in direct thermography of images with fairly low gradation.

Other objects and advantages of the present invention will appear from the further description.

In accordance with the present invention a non-photosensitive heat-sensitive recording material is provided suited for use in direct thermal imaging by means of information-wise energized heating elements, wherein said recording material comprises:

(i) at least two imaging layers each containing uniformly distributed in a film-forming resin binder (1) a substantially light-insensitive metal salt in thermal working relationship with (2) an organic reducing agent, and (ii) at least one heat-attenuating spacer layer for separating said imaging layers from each other.

The present invention includes likewise the use of said recording material in direct thermal imaging.

In particular the present invention provides a thermographic recording method, wherein said heat-sensitive recording material is image-wise heated by means of a thermal head containing a plurality of image-wise electrically energized heating elements, and said heat-attenuating layer results in a reduction of gradation, i.e. an increase of the number of gray levels, of images obtained by said heating.

By "thermal working relationship" is meant here that said substantially light-insensitive metal salt and said reducing agent by means of heat can react to form the metal itself. For that purpose said ingredients (1) and (2) may be present in a same layer or different layers wherefrom by heat they can come into reactive contact with each other, e.g. by diffusion or mixing in the melt.

BRIEF DESCRIPTION OF THE DRAWING

For comparison purposes characteristic curves from prints obtained in heat-sensitive "non-invention" and "invention" materials are given in the accompanying drawing. Said characteristic curves were obtained by plotting optical density (D) (logarithmic values) in the ordinate and linearly increasing amounts of heat (relative values) (rel. H) in the abscissa.

DETAILED DESCRIPTION OF THE INVENTION

Figure 1:
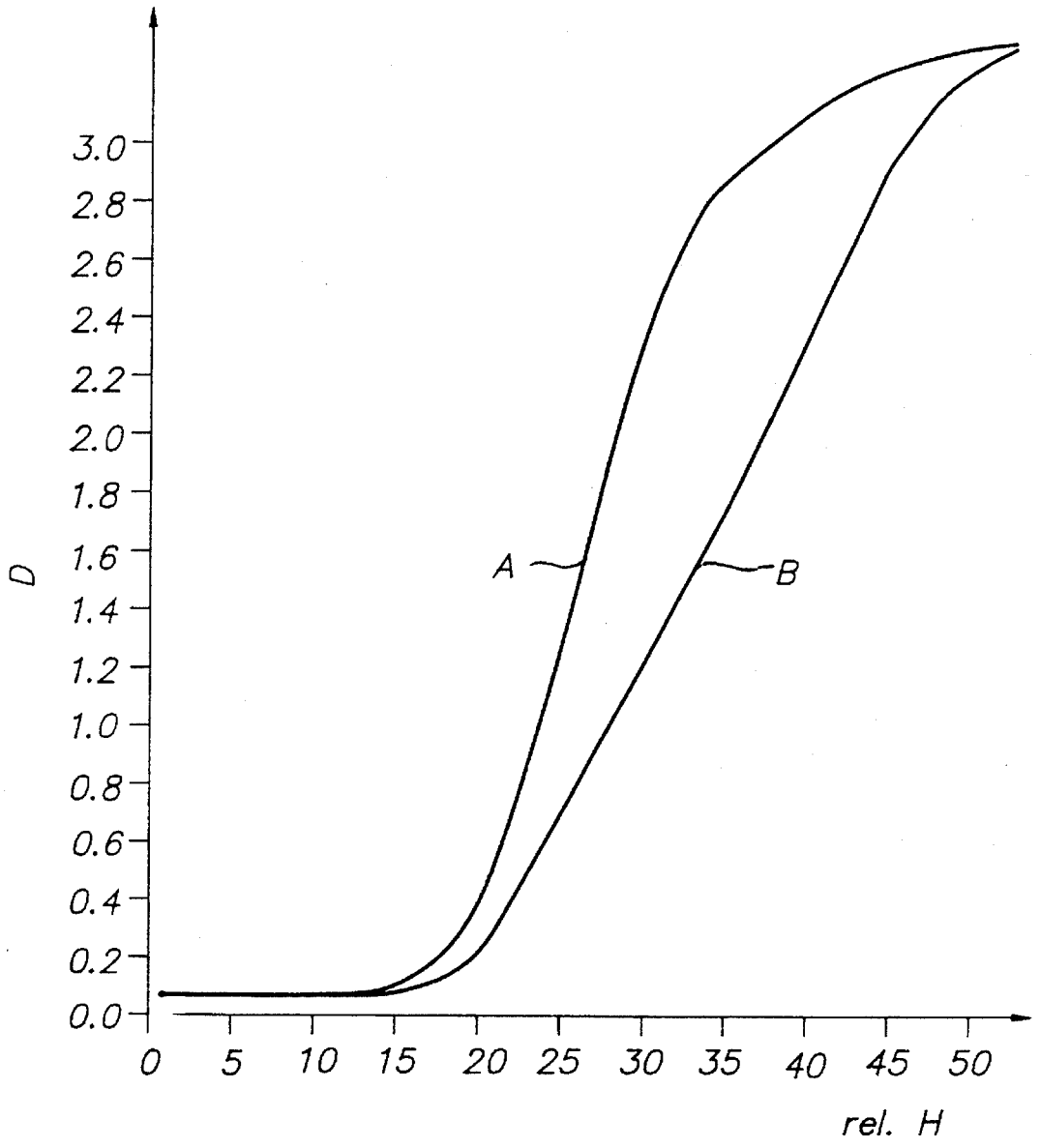

The term "gradation" refers to the slope of a characteristic curve representing the relationship of optical density (D) plotted in the ordinate versus linearly increasing amounts of heat plotted in the abscissa, said different amounts of heat being applied to the thermographic material in neighbouring area analogously to the production of a stepwedge. Linearly increasing amounts of heat are obtained with a thermal recording head wherein the heating time of the heating elements at constant Joule input increases linearly.

So, the linear increase of heat is obtained e.g. by linearly increasing the heating time at different areas of the recording material while keeping the heat input (J) per time unit (s) constant; alternatively the heating time can be kept constant and the amount of input-heat is increased linearly.

By definition all gradients or slopes of said characteristic curve create together the gradation of the thermographic image. A gradient corresponds with the slope at a single point on the characteristic curve. The gamma ($\gamma$) is the maximum gradient of said characteristic curve, which is normally the gradient between the end of the toe and the beginning of the shoulder of the characteristic curve. In praxis the gamma ($\gamma$) is the most important gradient determining the gray scale or the range of image tone reproduction.

The use of at least one spacer layer acting to some extent as a heat-insulating layer between neighbouring heat-sensitive imaging layers makes that the imaging layer more remote from the heating element(s) receive(s) less heat whereby the optical density in correspondence with the total heating range will be better differentiated giving rise to a larger amount of visually recognizable "gray-levels" in the final print.

The spacer layer(s) functioning as heat-attenuating layer(s) are preferably made of a film-forming transparent hydrophobic resin or polymer. Particularly suitable polymers for that purpose are polyesters and polycarbonates.

The thickness of the spacer layer(s) depends on their heat-insulating power which corresponds with a poor thermal conductivity, but for preventing a too strong reduction in sensitivity the thickness of one spacer layer or a group of spacer layers is preferably in the range of 5 to 30 μm.

According to a first embodiment heat-attenuating spacer layers are applied by coating a resin solution or dispersion, the latter being called a latex, and removing its liquid carrier by drying. Said liquid carrier is selected preferably in such a way that it is not a solvent for the binder in the underlying heat-sensitive imaging layer. Operating that way it is the intention not to disturb the image-forming characteristics of the heat-sensitive layer.

For example, according to a first embodiment the ingredients of the heat-sensitive layer containing polyvinyl butyral as binder are coated from a solution in which methyl ethyl ketone is the solvent and the resin of the heat-attenuating layer is coated from a rubber latex wherein water is the liquid medium being not a solvent for polyvinyl butyral.

According to a second embodiment heat-attenuating spacer layers are applied by lamination either or not using a glue or adhesive sticking layer.

Suitable heat-attenuating spacer layers that can be applied by lamination are polyethylene terephthalate or Bisphenol A-polycarbonate strata that are laminated by means of a pressure-sensitive adhesive layer to an underlying heat-sensitive layer, e.g. using a pressure-sensitive adhesive as described in U.S. Pat. No. 5,147,490.

Following the gist of the present invention a gradation-lowering effect is also obtained by including in the spacer layer(s) finely divided (colloidal) optically transparent inert pigments having heat-insulating power, such as transparent colloidal silica not masking the formed metal pattern.

In a preferred embodiment the metal salt used in the recording material of the present invention is a substantially light-insensitive organic silver salt.

Substantially light-insensitive organic silver salts particularly suited for use in recording materials according to the present invention are silver salts of aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, and likewise silver dodecyl sulphonate described in U.S. Pat. No. 4,504,575 and silver di-(2-ethylhexyl)-sulfosuccinate described in published European patent application 227 141. Useful modified aliphatic carboxylic acids with thioether group are described e.g. in GB-P 1,111,492 and other organic silver salts are described in GB-P 1,439,478, e.g. silver benzoate and silver phthalazinone, which may be used likewise to produce a thermally developable silver image. Further are mentioned silver imidazolates and the substantially light-insensitive inorganic or organic silver salt complexes described in U.S. Pat. No. 4,260,677.

Suitable organic reducing agents for the reduction of metal salts, preferably substantially light-insensitive organic silver salts, are organic compounds containing at least one active hydrogen atom linked to O, N or C, such as is the case in aromatic di- and tri-hydroxy compounds, e.g. hydroquinone and substituted hydroquinones, catechol, pyrogallol, gallic acid and gallates; aminophenols, METOL (tradename), p-phenylenediamines, alkoxynaphthols, e.g. 4-methoxy-1-naphthol described in U.S. Pat. No. 3,094,417, pyrazolidin-3-one type reducing agents, e.g. PHENIDONE (tradename), pyrazolin-5-ones, indanedione-1,3 derivatives, hydroxytetrone acids, hydroxytetronimides, hydroxylamine derivatives (ref. e.g. U.S. Pat. No. 4,082,901), hydrazine derivatives, reductones, and ascorbic acid; see also U.S. Pat. Nos. 3,074,809, 3,080,254, 3,094,417 and 3,887,378.

It has been experimentally stated by us that an improved continuous tone reproduction can be obtained by the use of heat-sensitive recording materials containing a catechol-type reducing agent, by which is meant a reducing agent containing at least one benzene nucleus with two hydroxy groups (—OH) in ortho-position.

Preferred are catechol and polyhydroxy spiro-bis-indane compounds corresponding to the following general formula:

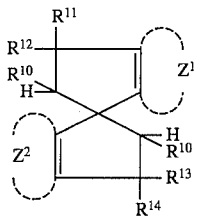

(I)

wherein:

$R^{10}$ represents hydrogen or alkyl, e.g. methyl or ethyl, each of $R^{11}$ and $R^{12}$ (same or different) represents H, an alkyl group, e.g. methyl, ethyl or propyl, an alkenyl group or a cycloalkyl group, e.g. cyclohexyl group, or $R^{11}$ and $R^{12}$ together represent the atoms necessary to close a homocyclic non-aromatic ring, e.g. a cylohexyl ring, each of $R^{13}$ and $R^{14}$ (same or different) represents H, an alkyl group, e.g. methyl, ethyl or propyl, an alkenyl group or a cycloalkyl group, e.g. cyclohexyl group, or $R^{13}$ and $R^{14}$ together represent the atoms necessary to close a homocyclic non-aromatic ring, e.g. cyclohexyl, each of $Z^1$ and $Z^2$ (same or different) represents the atoms necessary to close an aromatic ring or ring system, e.g. benzene ring, substituted with at least two hydroxyl groups in ortho- or para-position and optionally further substituted with at least one hydrocarbon group, e.g an alkyl or aryl group.

Particularly useful are the polyhydroxy-spiro-bis-indane compounds described in U.S. Pat. No. 3,440,049 as photographic tanning agent, more especially 3,3,3', 3' -tetramethyl-5,6,5',6'-tetrahydroxy-1,1'- spiro-bis-indane (called indane I) and 3,3,3',3'-tetramethyl-4,6,7,4',6',7'-hexahydroxy-1,1'-spiro-bis-indane (called indane II) . Indane is also known under the name hydrindene.

Preferably the reducing agent is added to the heat-sensitive imaging layer but as already mentioned all or part of the reducing agent may be added to an adjacent layer wherefrom it can diffuse into the layer containing the substantially light-insensitive silver salt.

The present heat-sensitive recording material may contain one or more primary reducing agents of the type defined above in combination with one or more auxiliary reducing agents having poor reducing power compared with said main reducing agents. The auxiliary reducing agents are incorporated preferably in the heat-sensitive layer containing the organic silver salt. For that purpose sterically hindered phenols and aromatic sulphonamide compounds are useful.

Sterically hindered phenols as described e.g. in U.S. Pat. No. 4,001,026 are examples of such auxiliary reducing agents that can be used in admixture with said organic silver salts without premature reduction reaction and fog-formation at room temperature.

The silver image density depends on the coverage of the above defined reducing agent(s) and organic silver salt(s) and has to be preferably such that on heating above 100° C. an optical density of at least 1.5 can be obtained. Preferably at least 0.10 mole of reducing agent(s) per mole of organic silver salt is used.

For obtaining a neutral black image tone with silver formed in the higher optical density parts and neutral grey in the lower densities the reducible silver salt(s) and reducing agents are advantageously used in conjunction with a so-called toning agent known from thermography or photothermography.

Suitable toning agents are the phthalimides and phthalazinones within the scope of the general formulae described in U.S. Pat. No. 4,082,901. Further reference is made to the toning agents described in U.S. Pat. Nos. 3,074,809, 3,446,648 and 3,844,797. Particularly useful toning agents are likewise the heterocyclic toner compounds of the benzoxazine dione or naphthoxazine dione type.

A toner compound particularly suited for use in combination with said polyhydroxy spiro-bis-indane reducing agents is 3,4-dihydro-2,4-dioxo-1,3,2H-benzoxazine described in U.S. Pat. No. 3,951,660.

As binding agent for the heat-sensitive imaging layer preferably thermoplastic water-insoluble resins are used wherein the ingredients can be dispersed homogeneously or form therewith a solid-state solution. For that purpose all kinds of natural, modified natural or synthetic resins may be used, e.g. cellulose derivatives such as ethylcellulose, cellulose esters, carboxymethylcellulose, starch ethers, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals, e.g. polyvinyl butyral, copolymers of acrylonitrile and acrylamide, polyacrylic acid esters, polymethacrylic acid esters, polystyrene and polyethylene or mixtures thereof. A particularly suitable ecologically interesting (halogen-free) binder is polyvinyl butyral. A polyvinyl butyral containing some vinyl alcohol units is marketed under the trade name BUTVAR B79 of Monsanto USA.

The binder to organic silver salt weight ratio is preferably in the range of 0.2 to 6, and the total thickness of all the heat-sensitive imaging layers present in the thermosensitive recording material according to the present invention should preferably be in the range of 5 to 16 μm.

The layer containing the organic silver salt is commonly coated on a support in sheet- or web-form from an organic solvent containing the binder dissolved therein but may be applied from an aqueous medium as a latex, i.e. as aqueous polymer dispersion. For use as a latex the dispersable polymer has preferably some hydrophilic functionality. Polymers with hydrophilic functionality for forming an aqueous polymer dispersion (latex) are described e.g. in U.S. Pat. No. 5,006,451, but serve therein for forming a barrier layer preventing unwanted diffusion of vanadium pentoxide present as antistatic agent.

The heat-sensitive layer containing the organic substantially light-insensitive silver salt and optionally an adjacent layer containing a reducing agent may contain waxes or "heat solvents" also called "thermal solvents" or "thermo-solvents" improving the reaction speed of the redox-reaction at elevated temperature.

By the term "heat solvent" in this invention is meant a non-hydrolyzable organic material which is in solid state in the recording layer at temperatures below 50° C. but becomes a plasticizer for the recording layer in the heated region and/or liquid solvent for the reducing agent combined with the organic silver salt, at a temperature above 60° C. Useful for that purpose are a polyethylene glycol having a mean molecular weight in the range of 1,500 to 20,000 described in U.S. Pat. No. 3,347,675. Further are mentioned compounds such as urea, methyl sulfonamide and ethylene carbonate being heat solvents described in U.S. Pat. No. 3,667,959, and compounds such as tetrahydro-thiophene-1, 1-dioxide, methyl anisate and 1,10-decanediol being described as heat solvents in Research Disclosure, December 1976, (item 15027) pages 26–28. Still other examples of heat solvents have been described in U.S. Pat. No. 3,438,776, and 4,740,446, and in published EP-A 0 119 615 and 0 122 512 and DE-A 3 339 810.

In addition to said ingredients the heat-sensitive layers may contain other additives such as free fatty acids, surface-active agents, antistatic agents, e.g. non-ionic antistatic agents including a fluorocarbon group as e.g. in $F_3C(CF_2)_6CONH(CH_2CH_2O)$—H, ultraviolet light absorbing compounds, white light reflecting and/or ultraviolet radiation reflecting pigments, colloidal silica, and/or optical brightening agents.

In the recording material according to the present invention the at least two heat-sensitive layers, that are separated from each other by at least one heat-attenuating spacer layer, not necessarily have the same composition. By which is meant that e.g. ingredients influencing image color, optical density and gradients may be different. Moreover, said heat-sensitive layers may have different thickness and coverage of said ingredients.

Direct thermal imaging can be used for both the production of transparencies and reflection type prints. Such means that the support may be transparent or opaque, e.g. the support has a white light reflecting aspect. For example, a paper base, e.g. polyolefine-coated paper base is used which may contain white light reflecting pigments, optionally also applied in an interlayer between the recording layer and said base. In case a transparent base is used, said base may be colourless or coloured, e.g. has a blue colour.

In the hard copy field, recording materials on white opaque base are used, whereas in the medical diagnostic field black-imaged transparencies find wide application in inspection techniques operating with a light box.

A transparent support of the heat-sensitive recording material according to the present invention is preferably a thin flexible resin carrier made e.g. from a cellulose ester, e.g. cellulose triacetate, polypropylene, polycarbonate or polyester, e.g. polyethylene terephthalate. The support may be in sheet, ribbon or web form and may be subbed if need be to improve the adherence to the thereon coated heat-sensitive recording layer.

The coating of the heat-sensitive layers may proceed by any coating technique e.g. as described in Modern Coating and Drying Technology, edited by Edward D. Cohen and Edgar B. Gutoff, (1992) VCH Publishers Inc. 220 East 23rd Street, Suite 909 New York, N.Y. 10010, U.S.A.

The recording materials of the present invention are particularly suited for use in thermographic recording techniques operating with thermal printheads. Suitable thermal printheads are e.g. a Fujitsu Thermal Head (FTP-040 MCS001), a TDK Thermal Head F415 HH7-1089, and a Rohm Thermal Head KE 2008-F3.

According to the present invention an image can be obtained by image-wise heating the above defined recording materials while moving the recording material with its imaging side in contact with a stationary thermal head. The recording material locally reach a temperature of up to 400° C. by varying the number of heat pulses given off by the thermal head. By varying the number of heat pulses the density of the corresponding image pixel is varied correspondingly.

In a particular embodiment in order to avoid direct contact of the print-heads with the recording layer that has not been provided with an outermost protective layer, the imagewise heating of an imaging layer proceeds through a contacting but removable resin sheet or web wherefrom during said heating no transfer of imaging material to the printhead can take place.

In another embodiment in order to avoid local deformation of the relatively weak imaging layer, to improve resistance against abrasion and in order to avoid the direct contact of the printheads with the recording layer a protective coating is applied thereto. Such coating may have the same composition as an anti-sticking coating or slipping layer which is applied in thermal dye transfer materials at the rear side of the dye donor material.

A slipping layer being said outermost layer may comprise a dissolved lubricating material and/or particulate lubricating material, e.g. talc particles, optionally protruding from the outermost layer. Examples of suitable lubricating materials are a surface active agent, a liquid lubricant, a solid lubricant or mixtures thereof, with or without a polymeric binder. The surface active agents may be any agents known in the art such as carboxylates, sulfonates, phosphates, aliphatic amine salts, aliphatic quaternary ammonium salts, polyoxyethylene alkyl ethers, polyethylene glycol fatty acid esters, fluoroalkyl $C_2$–$C_{20}$ aliphatic acids. Examples of liquid lubricants include silicone oils, e.g. BAYSILONE Öl (tradename of BAYER AG, Germany), synthetic oils, saturated hydrocarbons and glycols. Examples of solid lubricants include various higher alcohols such as stearyl alcohol, fatty acids and fatty acid esters. Suitable slipping layer compositions are described in e.g. EP 138483, EP 227090, U.S. Pat. No. 4,567,113, 4,572,860 and 4,717,711 and in published European patent application 311841.

A suitable slipping layer being here an outermost layer at the recording layer side comprises as binder a styrene-acrylonitrile copolymer or a styrene-acrylonitrile-butadiene copolymer or a mixture hereof and as lubricant in an amount of 0.1 to 10% by weight of the binder (mixture) a polysiloxane-polyether copolymer or polytetrafluoroethylene or a mixture hereof.

Another suitable outermost slipping layer may be obtained by coating a solution of at least one silicon comound and a substance capable of forming during the coating procedure a polymer having an inorganic backbone which is an oxide of a group IVa or IVb element as described in published European patent application 0554576.

Other suitable protective layer compositions that may be applied as slipping (anti-stick) coating are described e.g. in published European patent applications (EP-A) 0 501 072 and 0 492 411.

The following example illustrates the present invention. The percentages and ratios are by weight unless otherwise indicated.

EXAMPLE 1 (Comparative Example)

Thermosensitive recording material A (Non-Invention Material)

A subbed polyethylene terephthalate support having a thickness of 100 μm was doctor blade-coated from a coating composition containing methyl ethyl ketone as a solvent and the following ingredients so as to obtain thereon after drying the following recording layer containing:

| | |
|---|---|
| silver behenate | 3.20 g/m$^2$ |
| polyvinyl butyral (BUTVAR B79-tradename) | 3.20 g/m$^2$ |
| reducing agent S as defined hereinafter | 0.60 g/m$^2$ |
| 3,4-dihydro-2,4-dioxo-1,3,2H-benzoxazine | 0.22 g/m$^2$ |
| BAYSILON Öl (tradename) | 12 mg/m$^2$ |

Reducing agent S is a polyhydroxy spiro-bis-indane, viz. 3,3,3',3'-tetramethyl- 5,6,5',6'-tetrahydroxy-spiro-bis-indane.

Thermosensitive recording material B (Invention Material)

A subbed polyethylene terephthalate support having a thickness of 100 μm was doctor blade-coated from methyl ethyl ketone as solvent so as to obtain after drying the following first thermosensitive imaging layer containing:

| | |
|---|---|
| silver behenate | 1.60 g/m$^2$ |
| polyvinyl butyral (BUTVAR B79-tradename) | 1.60 g/m$^2$ |
| reducing agent S as defined hereinafter | 0.30 g/m$^2$ |
| 3,4-dihydro-2,4-dioxo-1,3,2H-benzoxazine | 0.11 g/m$^2$ |
| BAYSILON Öl A (tradename) | 6 mg/m$^2$ |

Onto said first thermosensitive imaging layer a spacer layer was applied from the following aqueous polymer dispersion:

| | |
|---|---|
| 25% latex of copoly(ethyl acrylate, methylmethacrylate methacrylic acid) (50/33.5/16.5) | 10 g |
| ULTRAVON W (tradename of Ciba Geigy) wetting agent | 10 mg |

The solids coverage after drying was 25 g/m$^2$.

Onto said dried spacer layer a hydrophilic barrier layer on the basis of gelatin was coated from aqueous medium. By the fact that a gelatin layer forms an impermeable barrier for methyl ethyl ketone containing dissolved reducing agent, diffusion of said reducing agent from the second thermosensitive imaging layer into the first thermosensitive imaging layer is prevented.

The coverage of gelatin after drying was 2 g/m$^2$.

Onto that hydrophilic barrier layer a second thermosensitive imaging layer having the same composition as the first imaging layer was coated and dried.

Thermographic Printing

Both said recording materials A and B were exposed to a pattern of linearly increasing amounts of heat in a thermal head printer built for thermosensitometric purposes, using a same separatable polyethylene terephthalate ribbon of 6 μm thick between the thermal print head and outermost heat-sensitive layer of the recording materials.

From the prints obtained in said materials A and B characteristic curves A and B respectively were plotted in FIG. 1 with optical density (D) (logarithmic values) in the ordinate and linearly increasing amounts of heat (relative values) (rel. H) in the abscissa.

The optical density was measured in transmission with MacBeth TD 904 densitometer behind ortho-filter having its main transmission in the green part (500 nm to 600 nm) of the visible spectrum.

From the comparison of these curves can be learned that the slope of the linear part of the curve B corresponding with the invention material B is much less steep (58°) than the slope of the linear part of curve A from non-invention material A (70°). Such corresponds with a gamma value for the non-invention material A of 2.74 and a gamma value for the invention-material B of 1.60.

EXAMPLE 2 (Comparative Example)

Thermosensitive Recording Material A (Non-Invention Material)

The composition of said thermosensitive (non-invention) recording material A was the same as described in Example 1.

Thermosensitive Recording Materials C (Invention Material)

Material C1

A polyethylene terephthalate support having a thickness of 100 μm was doctor blade-coated at a wet coating thickness of 27 g/m$^2$ from a coating composition containing 100 g of methyl ethyl ketone as solvent and the following ingredients so as to obtain after drying a coated layer C1 having the following composition:

| | |
|---|---|
| silver behenate | 1.60 g/m$^2$ |
| polyvinyl butyral (BUTVAR B79-tradename) | 1.60 g/m$^2$ |
| reducing agent S as defined hereinbefore | 0.30 g/m$^2$ |
| 3,4-dihydro-2,4-dioxo-1,3,2H-benzoxazine | 0.11 g/m$^2$ |
| BAYSILON Öl A (tradename) | 6.0 mg/m$^2$ |

Material C2

Material C2 has the same composition as material C1 with the difference that the polyethylene terephthalate support had a thickness of 8 μm.

Recording material C was prepared by laminating material C2 onto material C1 with its 8 μm thick support into contact with the thermosensitive layer of material C1.

The lamination proceeded with a commercial roll laminator with a lamination speed of 50 cm/minute while keeping the laminator rollers at 80° C.

Thermographic Printing

Said recording materials A and C were exposed to a pattern of linearly increasing amounts of heat in a thermal head printer built for thermosensitometric purposes, using a same separatable polyethylene terephthalate ribbon of 6 μm thick between the thermal print head and outermost heat-sensitive layer of the recording materials.

By the applied heating procedure a wedge print having 64 steps was obtained.

Figure 2:
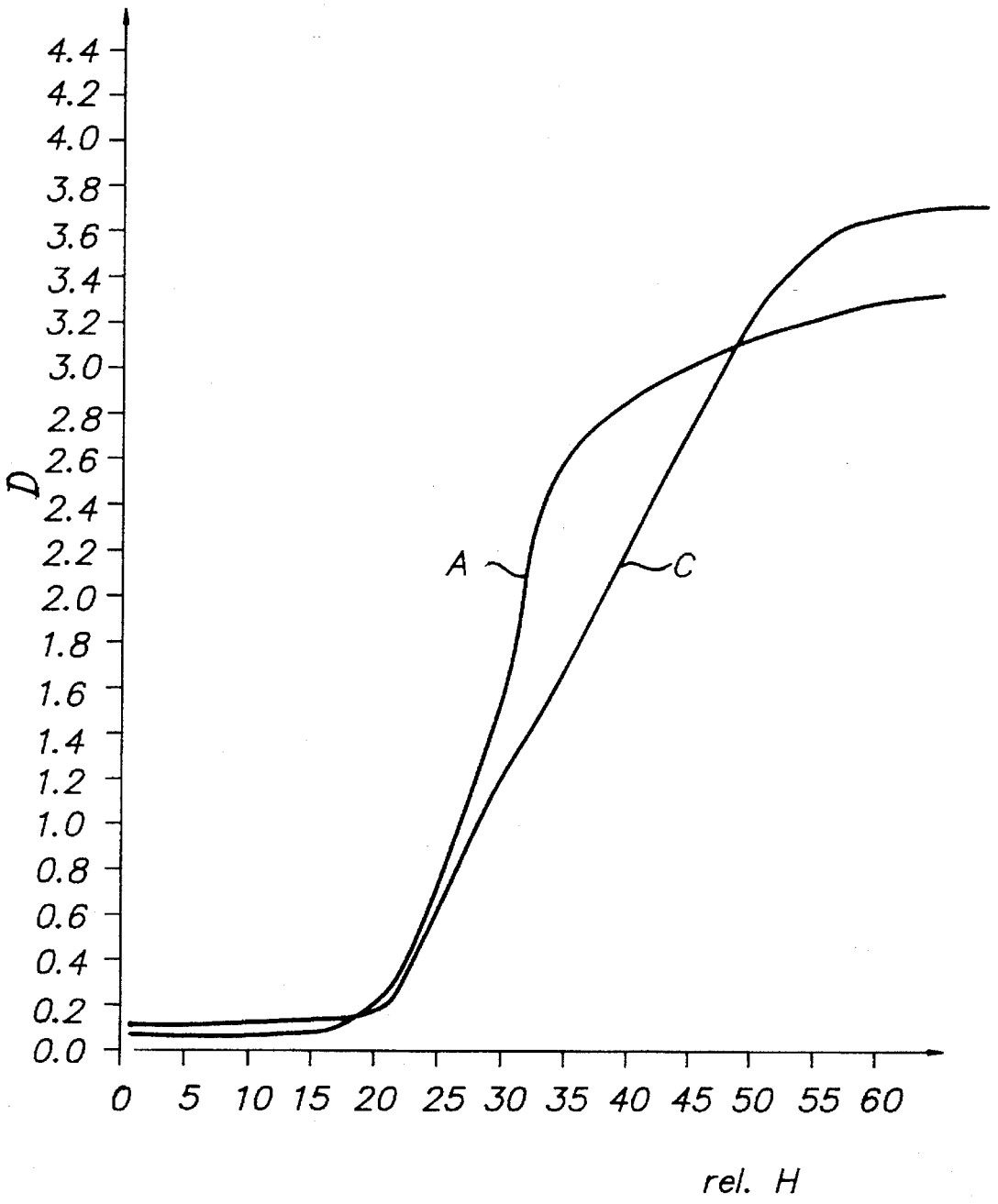

From the prints obtained in said materials A and C characteristic curves A and C respectively were plotted in FIG. 2 with optical density (D) (logarithmic values) in the ordinate and linearly increasing amounts of heat (relative values) (rel. H) in the abscissa.

The optical density was measured in transmission with a MacBeth TD 904 densitometer behind ortho-filter having its main transmission in the green part (500 nm to 600 nm) of the visible spectrum.

From the comparison of these curves can be learned that the slope of the linear part of the curve C corresponding with the invention material C is much less steep (56°) than the slope of the linear part of curve A from non-invention material A (68°). Such corresponds with a gamma value for the non-invention material A of 2.47 and a gamma value for the invention-material C of 1.48.

In the above Example 2 the two heat-sensitive layers of invention material C are identical. It is possible however to make them different in composition and/or thickness whereby the steepness of the sensitometric curve can be tailor-make, e.g. the toe can be made less steep while maintaining the steepness of the shoulder part.

We claim:

1. A non-photosensitive heat-sensitive recording material suited for use in direct thermal imaging by means of information-wise energized heating elements, wherein said recording material comprises:

(i) at least two imaging layers each containing uniformly distributed in a film-forming resin binder (1) a metal salt in thermal working relationship with (2) an organic reducing agent, and (ii) one heat-attenuating spacer layer or group of spacer layers for separating said imaging layers from each other, wherein the thickness of the one spacer layer or group of spacer layers is in the range of 5 to 30 μm.

2. Recording material according to claim 1, wherein the spacer layer(s) functioning as heat-attenuating layer(s) are made of a film-forming transparent hydrophobic resin or polymer.

3. Recording material according to claim 1, wherein said spacer layer(s) is (are) made of a polyester or polycarbonate.

4. Recording layer according to claim 1, wherein said spacer layer is applied by coating a resin solution or dispersion and removing its liquid carrier by drying, and wherein said liquid carrier is not a solvent for the binder in an underlying heat-sensitive imaging layer.

5. Recording material according to claim 4, wherein said spacer layer is made by radiation-polymerizable liquid monomers that optionally contain dissolved copolymerizable pre-polymers or dissolved polymers.

6. Recording material according to according to claim 1, wherein said spacer layer is applied by lamination either or not using an adhesive.

7. Recording material according to claim 1, wherein said metal salt is a substantially light-insensitive silver salt.

8. Recording material according to claim 7, wherein said silver salt is a silver salt of an aliphatic carboxylic acid wherein the aliphatic carbon chain has at least 12 C-atoms.

9. Recording material according to claim 1, wherein said reducing agent is a compound containing at least one benzene nucleus with two hydroxy groups in ortho-position as in catechol.

10. Thermographic recording method, wherein a non-photosensitive heat-sensitive recording material is image-wise heated by said material comprising:

(i) at least two imaging layers each containing uniformly distributed in a film-forming resin binder (1) a metal salt in thermal working relationship with (2) an organic reducing agent, and (ii) one heat-attenuating spacer layer or group of spacer layers for separating said imaging layers from each other, wherein the thickness of the one spacer layer or group of spacer layers is in the range of 5 to 30 μm.

11. A non-photosensitive heat-sensitive recording material suited for use in direct thermal imaging by means of information-wise energized heating elements, wherein said recording material comprises:

(i) at least two imaging layers each containing uniformly distributed in a film-forming resin binder (1) a metal salt in thermal working relationship with (2) an organic reducing agent, and (ii) one heat-attenuating spacer layer or group of spacer layers for separating said imaging layers from each other, wherein the one spacer layer or group of spacer layers comprises a film-forming transparent hydrophobic resin or polymer.

12. A non-photosensitive heat-sensitive recording material suited for use in direct thermal imaging by means of information-wise energized heating elements, wherein said recording material comprises:

(i) at least two imaging layers each containing uniformly distributed in a film-forming resin binder (1) a metal salt in thermal working relationship with (2) an organic reducing agent, and (ii) one heat-attenuating spacer layer or group of spacer layers for separating said imaging layers from each other, wherein the one spacer layer or group of spacer layers comprises a polyester or polycarbonate.

* * * * *